United States Patent [19]

Oshikoshi et al.

[11] Patent Number: 4,928,996

[45] Date of Patent: May 29, 1990

[54] BOOKLET WITH PHOTOGRAPH

[75] Inventors: Yuji Oshikoshi; Yoshimi Suganuma, both of Tokyo; Hiroshi Hara, Kanagawa; Kazuo Shiota, Kanagawa; Nobumitsu Takehara, Kanagawa; Kiichiro Sakamoto, Kanagawa, all of Japan

[73] Assignee: Fuji Photo Film Co., Ltd., Kanagawa, Japan

[21] Appl. No.: 261,195

[22] Filed: Oct. 24, 1988

[30] Foreign Application Priority Data

Oct. 23, 1987 [JP] Japan ..... 62-267848
Mar. 4, 1988 [JP] Japan ..... 63-51199
Mar. 4, 1988 [JP] Japan ..... 63-51200

[51] Int. Cl.[5] ..... B42D 15/00

[52] U.S. Cl. ..... 283/109; 283/74; 283/77; 283/82; 283/75; 283/112

[58] Field of Search ..... 430/10, 12; 156/87, 156/289; 283/74, 75, 77, 82, 83, 109, 112; 355/109

[56] References Cited

U.S. PATENT DOCUMENTS

| | | | |
|---|---|---|---|
| 3,505,140 | 4/1970 | Dunn | 156/289 |
| 3,647,442 | 3/1972 | Malster | 283/904 |
| 3,928,863 | 12/1975 | Stewart et al. | 354/109 |
| 4,287,285 | 9/1981 | Mosehauer | 283/109 |
| 4,500,626 | 2/1985 | Naito et al. | 430/223 |
| 4,536,015 | 8/1985 | Kirstein | 283/904 |
| 4,687,526 | 8/1987 | Wilfert | 283/77 |

FOREIGN PATENT DOCUMENTS

| | | |
|---|---|---|
| 59-218443 | 12/1984 | Japan . |
| 60-133449 | 7/1985 | Japan . |
| 61-238056 | 10/1986 | Japan . |
| 61-269147 | 11/1986 | Japan . |

OTHER PUBLICATIONS

European Patent Application No. EP 0 210 660 A2, 2/87.

European Patent Application No. EP 0 220 746 A2, 5/87.

*Primary Examiner*—Frank T. Yost
*Assistant Examiner*—Tom Hamill, Jr.
*Attorney, Agent, or Firm*—Sughrue, Mion, Zinn, Macpeak & Seas

[57] ABSTRACT

A booklet, such as a passport, for providing the identity of the holder thereof, with a picture of the face and personal data of the bookholder, includes transparent and supporting sheets bound in the booklet separately from and adjacent to each other. Furthermore, an image receiving layer is formed on one surface of one of the separate transparent and supporting sheets and an optically readable data printing section is provided on either one of the transparent and supporting sheets where optically readable personal data of said booklet holder is printed. Also, an adhesive layer is provided for adhering the transparent and supporting sheets together to sandwich the image receiving layer therebetween after having formed a composite image of the picture and personal data in the image receiving layer.

17 Claims, 17 Drawing Sheets

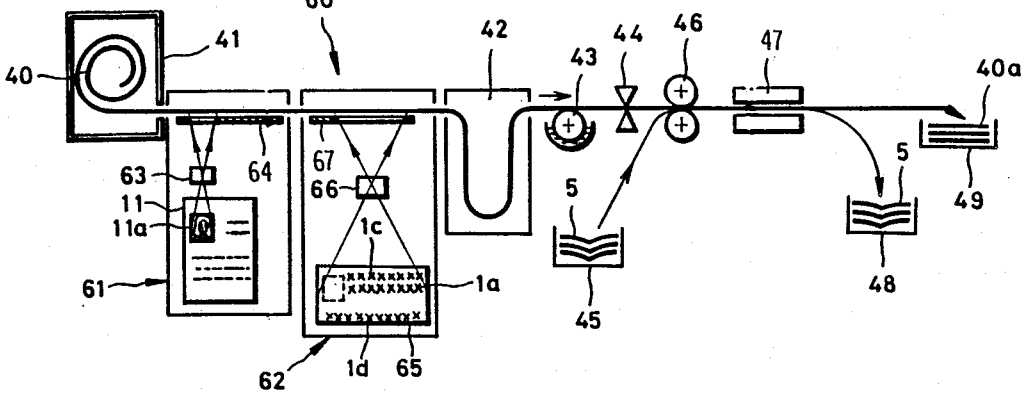
FIG. 10
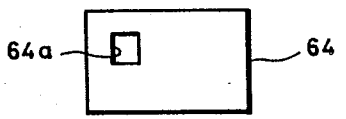
FIG. 11A
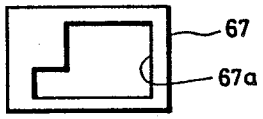
FIG. 11C
FIG. 11B
FIG. 11D

BOOKLET WITH PHOTOGRAPH

BACKGROUND OF THE INVENTION

The present invention relates to personal booklets with photographs, and more particularly to personal booklets having a page with a composite image comprising a picture of the bookholder and personal data relating to the bookholder.

Personal booklets such as passports, bankbooks and so forth have a picture of the bookholder's face attached to one of the pages thereof as well as the bookholder's personal data including the name, nationality, date of birth, sex, date of issue, a personal identification number, and so forth to provide the bookholder's identity. The picture is covered by a transparent cover sheet and embossed with a seal in order to prevent the passport's forgery or alteration.

The passports are made through a process of entering the necessary personal data, attaching a picture of the face of the applicant, and covering the attached picture with a transparent cover sheet. This process is laborious and is inefficient in dealing with a large number of passports simultaneously. Consequently, the conventional process of making the passports retards the issuance of the passports.

It has been necessary for applicants to prepare, in addition to a picture of the applicant's face to be attached to the passport, an extra picture of the applicant's face which is attached to an application form when applying for a passport.

In recent years, with the growth of international passengers, machine readable passports (MRPs), in standard form worldwide, can have been experimentally introduced at airports of some countries in an attempt at relieving the confusion of passport control for the entry into, and departure from, a country. The holder's personal data on these MRPs can be read either optically, electrically, or visually by a particular machine.

The process of making the machine readable passport requires, in addition to the above-described steps, another step of providing machine readable personal data on the passport. Due to this additional step, it is slower to make the machine readable passports, hindering the issuance of passports accordingly.

SUMMARY OF THE INVENTION

Therefore, in view of the foregoing it, is an object of the present invention to provide a personal booklet with a picture of the face and personal data of the bookholder to provide the bookholder's identity which is difficult to forge or alter.

It is another object of the present invention to provide a personal booklet with a picture and machine readable personal data of the bookholder to provide the bookholder's identity which improves the process of making personal booklets.

In accordance with the present invention, the booklet comprises a transparent sheet bound in the booklet, an image receiving layer formed on one surface of the transparent sheet, a supporting sheet bound in the booklet separately from and next to the transparent sheet, the supporting sheet being adhered to the transparent sheet after having formed a composite image of a picture and personal data of the bookholder on the image receiving layer.

For easy adhesion of the supporting sheet to the transparent sheet, the supporting sheet has an adhesive layer pre-coated over one surface thereof. The adhesive layer may be applied to the surface of the supporting sheet after the composite image is formed on the image receiving layer or, otherwise, it may be a double-faced adhesive sheet. According to a feature of the present invention, a picture of the face of the bookholder or applicant, attached to an application form, and personal data, filled in on the application form, are optically printed on a thermal transfer photosensitive printing paper as a composite image. The thermal transfer photosensitive printing paper optically formed with the composite image is superimposed on the image receiving layer formed on the transparent sheet bound in the booklet so as to transfer thermally the composite image into the image receiving layer. Thereafter, the transparent sheet with the image receiving layer is adhered to a supporting sheet bound in the booklet next to the transparent sheet so as to form one page. Upon superimposing the thermal transfer photosensitive sheet and the image receiving layer on the transparent cover sheet, they are pressed by a pair of pressure applying rollers to squeeze out air therebetween.

The present invention avoids the necessity of directly attaching a picture of the face of the applicant to a booklet and directly typing personal data of the applicant on a page of the booklet, accordingly. Consequently, booklets with pictures can be prepared automatically and efficiently. When making passports with containing bookholder's pictures, no extra picture is necessary other than a picture attached to an application form. Furthermore, because it is quite easy to include optically readable characters as well as a picture of the applicant in a composite image, the passport made by the present invention can be used as a machine readable passport.

BRIEF DESCRIPTION OF THE DRAWINGS

The description refers to the accompanying drawings in which like reference characters refer to like parts throughout the several views, and in which:

FIG. 10 is a schematic side view of a printing apparatus for optically printing a composite image;

FIGS. 11A to 11D are explanatory illustrations showing exposure framing masks which are used in the printing apparatus of FIG. 10;

DETAILED DESCRIPTION OF THE PREFERRED EMBODIMENTS

Figure 1:
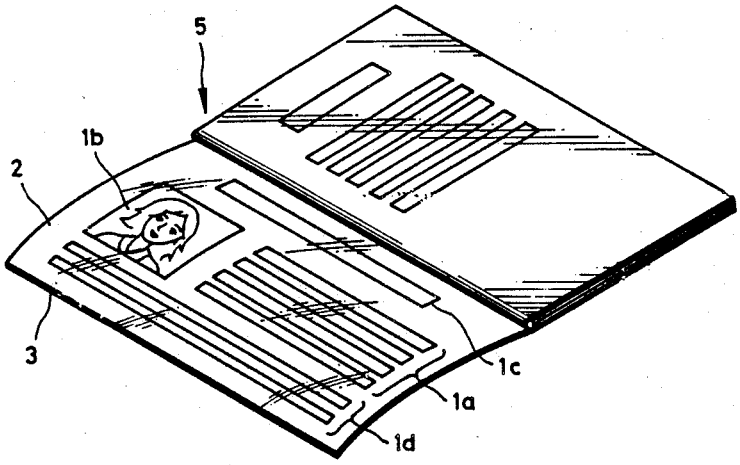
FIG. 1 shows a machine readable passport to which the present invention is applied.
Figure 2:
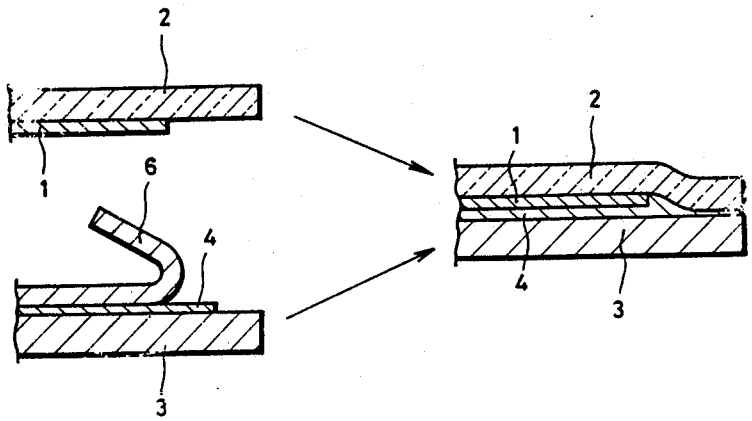
FIG. 2 illustrates the construction of the machine readable passport of FIG. 1.

In FIGS. 1 through 3, a machine readable passport (MRP) is shown according to a specific embodiment of the present invention. As shown, a machine readable passport 5 has a plurality of pages bound as one booklet. One of the pages, for example a front cover page, comprises a transparent sheet 2 with an image receiving layer 1 of about 0.01 mm in thickness coated onto the back surface thereof, and a supporting sheet 3 adhered to the back of the transparent sheet 2. In the image receiving layer 1, a composite image of personal data 1*a* and a picture 1*b* of the face of the passport holder, a graphic design 1*c*, and special data 1*d* in the form of optically readable characters are formed. The transparent sheet 2 with the image receiving layer 1 is heat-welded to the supporting sheet 3 by way of a heat-melt type adhesive layer 4 coated to the front surface thereof to form the first page of the machine readable passport 5.

Figures 3A, 3B, 3C:
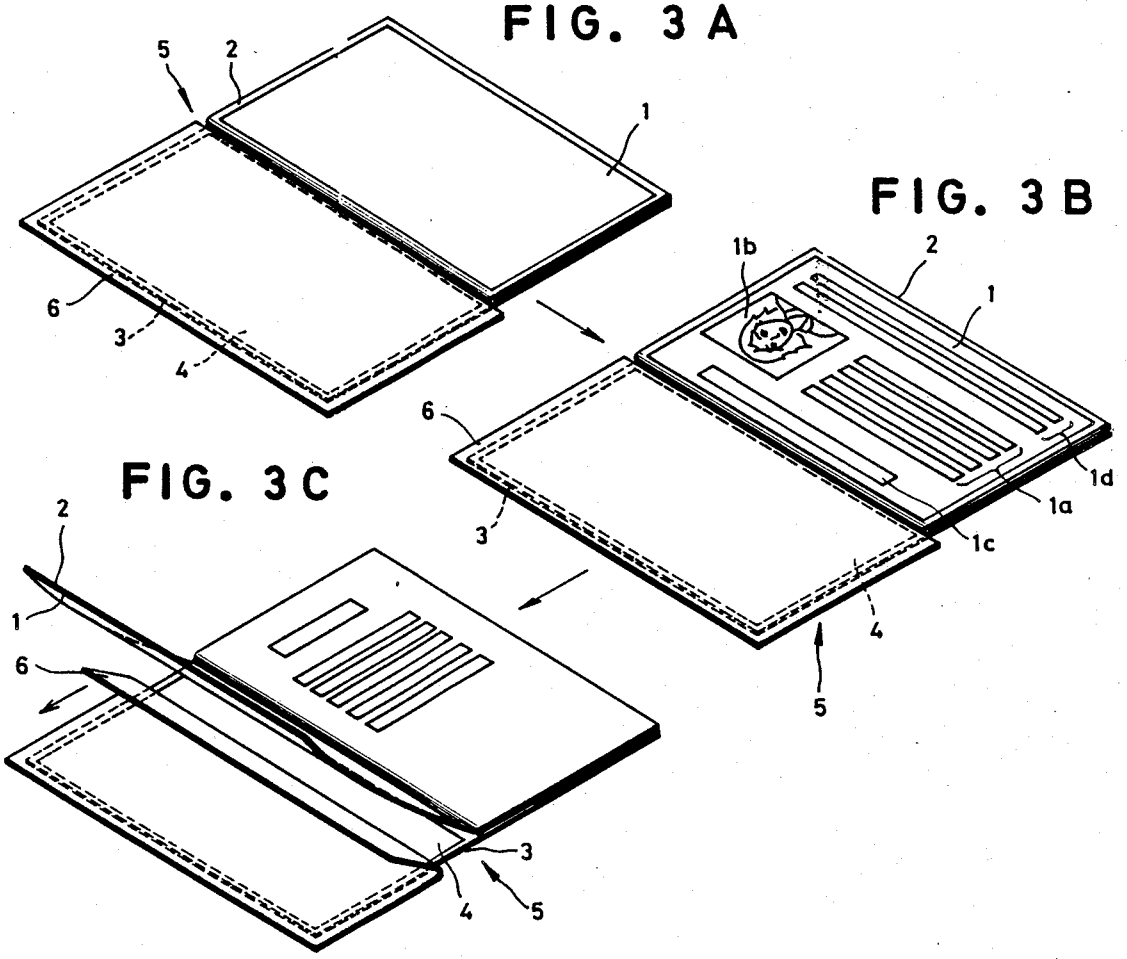
FIGS. 3A to 3C are perspective, exploded illustrations showing a sequence of making the machine readable passport of FIG. 1.

The supporting sheet 3, which is used as a front cover of the machine readable passport 5 shown in FIG. 3A, is made of, for example, paper sheets of a thickness between 0.1 and 0.8 mm, plastic sheets, combined sheets of plastic sheets and papers stuck together, or paper sheets with one or both sides laminated with plastic sheets. The plastic sheet is made, not exclusively but preferably, of polyethylene terephtalete, polycarbonate, acetylcellulose, cellulose ester, polybinilacetate, polystilen, polypropilene, polyvinyl chloride, nylon, polyethylene or the like. It is also preferable to mix white pigments such as $TiO_2$, ZnO etc., or to contain color pigments or dyes, in the plastics.

The transparent sheet 2, which is used as the inside page of the front cover, as shown in FIG. 3A, is made of transparent plastic sheets of about 0.05 to 0.35 mm thickness and is sized equivalent to or slightly smaller than the supporting sheet 3. Any one of the above-mentioned plastic materials available as the supporting sheet 3 may be used for the transparent sheet 2. As shown in FIG. 3B, a picture 1*b* of the face and personal data 1*a* of the passport holder, a graphic design 1*c* if necessary, and optically readable personal data 1*d* are transferred into the image receiving layer 1 in a thermal transfer process. As described below, the picture, design, and data 1*a* to 1*d* are laid out and are composed as a single composite image on a CRT screen with the aid of a computer. Then, a thermal transfer type photosensitive printing paper 40 is exposed to the CRT composed image displayed on the CRT screen to form a latent composite image therein through a three color frame sequence exposure. Thereafter, the photosensitive printing paper 40 is developed in a thermal developing process. The developed composite image is finally transferred onto the image receiving layer 1.

The image receiving layer 1 comprises substances including a dye fixer such as dye mordant agents, which can be chemically reactive on dye released from a thermally developable photosensitive layer of thermal printing paper 40. Any type of dye fixer may be selected according to the properties of dye released from the thermally developable photosensitive layer, chemical compositions of the thermally developable photosensitive layer, thermally transferring conditions and so forth. For example, it is preferable to use polymer mordant agents of a high molecular weight. The photosensitive thermal printing paper used in this embodiment may be any type of thermal transfer printing color paper. For example, the type of printing paper having releasing dye which is exposed to light and transferred to the dye fixer containing a mordant agent by the aid of a solvent such as water, the type of printing paper involving transferring released dye to the dye fixer with an organic solvent having a high boiling point, the type of printing paper involving transferring released dye to the dye fixer with a hydrophilic solvent contained in the dye fixer, the type of printing paper involving diffusing or sublimating released dye to transfer it to the dye fixer, etc. These types of thermal transfer photosensitive printing papers are well known in the art and are disclosed in, for example, U.S. Pat. No. 4,500,626, Japanese Unexamined Patent Publications Nos. 60-133,449, 59-218,443, 61-238,056, and European Patent No. 220,746A2 and so forth.

The adhesive layer of, for example, 0.001 to 0.2 mm in thickness is coated over the back surface of the supporting sheet 3 to which the image receiving layer 1 of the transparent sheet 2 is to be attached. Preferably, adhesive materials are used for the adhesive layer 4 which neither photographically nor chemically attack the transferred composite image onto the image receiving layer 1 but adheres the transparent and supporting sheets together quickly without forming air bubbles therebetween. It may be permissible to apply the adhesive layer 4 to the image receiving layer 1 after transferring the composite image thereto in place of applying it to the supporting sheet 3. Otherwise, an adhesive sheet or adhesive sheet with a peelable sheet to which adhesive material is applied may be used.

Figure 8:
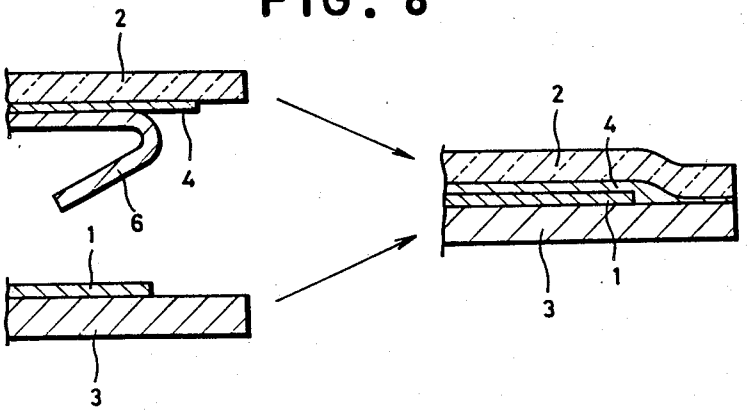
FIG. 8 is an explanatory illustration similar to FIG. 2, but showing another construction of the machine readable passport of FIG. 1.

A peelable sheet 6 is applied over the adhesive layer 4. This peelable sheet 6 is sized slightly larger than the supporting sheet 3 so that the periphery of the peelable sheet 6 is easily picked up between fingers and is peeled apart. If it is not easy to handle the passport booklet 5 during its preparation, the peelable sheet 6 may be sized equal to or smaller than the supporting sheet 3 as long as it is larger than the image receiving layer 1. It should be noted that, as shown in FIG. 8, the image receiving layer 1 may be formed on the supporting sheet 3 and the adhesive layer 4 may be correspondingly over the transparent cover sheet 2.

Figure 4:
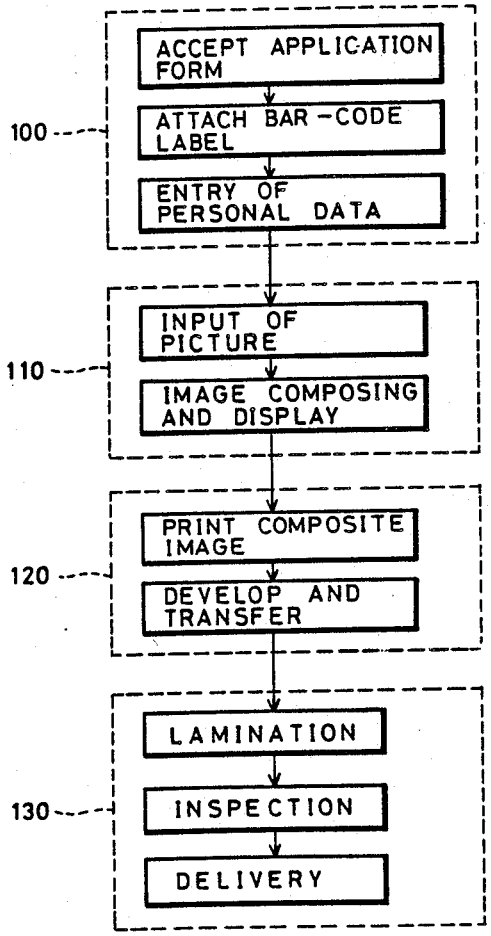
FIG. 4 is a flow chart illustrating the process of making the machine readable passport of the present invention shown in FIG. 1.
Figure 5:
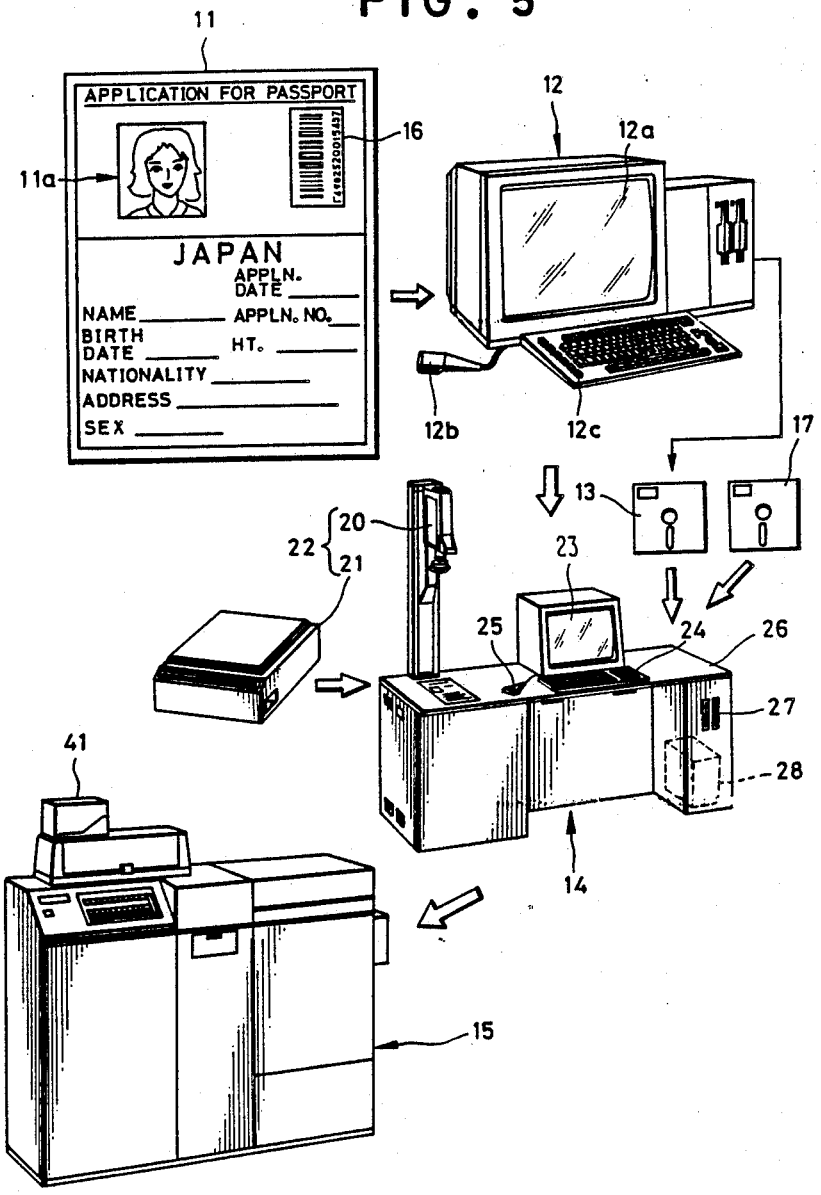
FIG. 5 illustrates a system of making the machine readable passport of the present invention.

The process of making machine readable passports will be described with reference to FIGS. 4 through 7. As shown in FIGS. 4 and 5, the machine readable passport 5 is prepared through a process of four steps, namely a data entry step 100, including the acceptance of an application form, an image composite step 110, a video image printing step 120, and a finishing step 130.

In the data entry step 100, after attaching a bar-code label 16 carrying a personal identification number to an application form 11, an operator prepares the necessary personal data for describing or identifying the applicant of a machine readable passport. Personal data includes the applicant's name, the date of birth, nationality, sex and so forth. Personal data is prepared by entering it with a word processor 12 having a CRT display 12*a*, a bar-code reader 12*b* and a keyboard 12*c* based on data filled in the application form 11 accepted and storing them in a floppy disk 13. The personal data is stored in the form of coded data along with the personal identifying number read out from the bar-code label 16.

Figure 6:
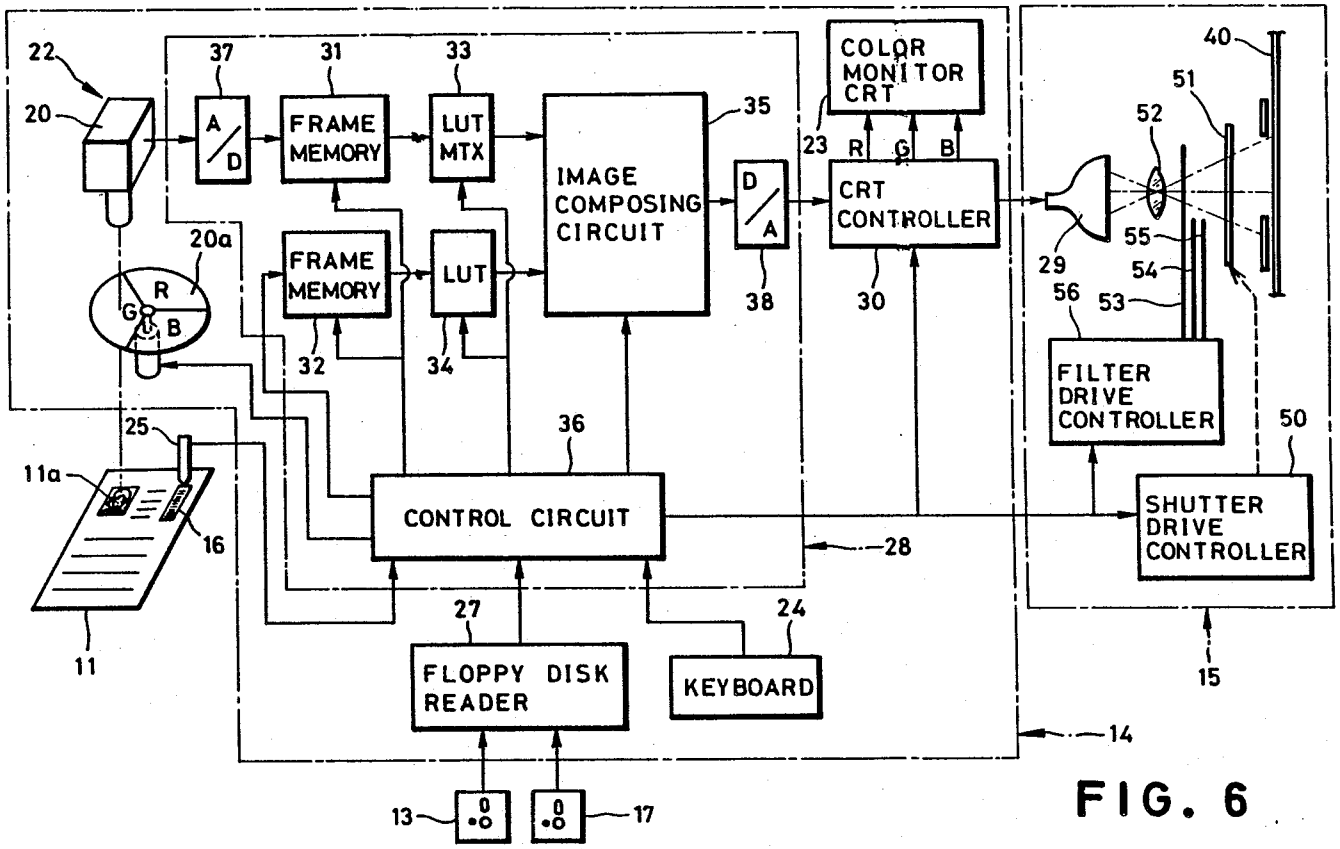
FIG. 6 is a block diagram showing a video printer and an image composing apparatus used in the system of FIG. 5.

In the image composite step 110, an image of the picture 11*a* of the face of the applicant attached to the application form 11 and the applicant's personal data are composed as a single composite image by an image composer 14. For editing a composite image on a color monitor comprising a color CRT display 23, the operator displays the picture 1*b* of the face of the applicant and the applicant's personal data 1*a* retrieved from the floppy disk 13, the data of the graphic design 1*c*, and the optically readable personal data 1*d* which are described based on the personal data inputted through a character generator. The image composer 14, as is shown in FIGS. 5 and 6, comprises a picture image input device 22 such as a TV camera 20 or a color image scanner 21, a color monitor CRT display 23, a console 26 having a keyboard 24 and a bar-code reader 25, a data reader 27 for reading the personal data stored in the floppy disk 13 and data of the graphic design stored in the floppy disk 17, an image composing unit 28 comprising a microcomputer for preparing a composite image from the data read from the floppy disks 13 and 17, and a CRT controller 30 for controlling the color monitor CRT 23 and a black-and-white CRT of the video printer 15. preferably a black-and-white TV camera is used as the TV camera because of its high resolving power. When using a black-and-white TV camera, a color separating means is required comprising three primary color filters, namely red, green and blue filters. Each filter being insertable into the optical axis of the black-and-white TV camera independently of the other two.

The image processing unit 28, as detailed in FIG. 6, reads out the image data of the applicant's picture 1*b* inputted through the picture image input device 22 and of the personal data of the applicant according to the applicant's personal identification number. The image data, the personal data of the applicant, and the graphic design data are stored in frame memories 31 and 32 under the control of a controller 30. Thereafter, the data are transferred to a look-up table matrix circuit 33 and a look-up table memory 34, respectively, for correcting gradation. Then, these data are composed in the image composing circuit 35. As shown by the arrows in FIG. 6, control circuit 36 controls sequentially each circuit or peripheral device of the image processing unit 28 so as to input images and characters, and then compose these images and characters. Control circuit 36 also controls video printing by video composer 14 and video printer 15. A/D and D/A converters, 37 and 38, respectively, convert video signals by color.

Figure 7:
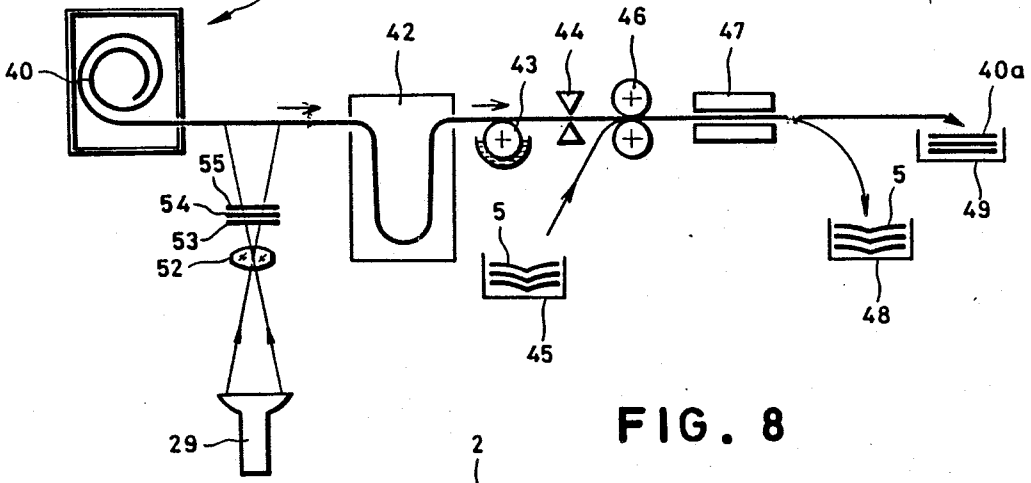
FIG. 7 is a schematic illustration showing a video printer used in the system of FIG. 5.

In the video image printing step 120, the composite image prepared in the image composing step 110 is printed on the thermal transfer type photosensitive printing paper 40. After development, the composite image is transferred to image receiving layer 1 by a video printer 15 in a thermal transfer process. The video printer 15, as shown in FIGS. 6 and 7, includes a paper cassette 41 containing a roll of thermal transfer type photosensitive printing paper 40, and a CRT 29 for displaying a composite image to which the printing paper 40 is exposed. The printer also includes an antechamber 42 for retaining the exposed printing paper 40 in the form of a loop, a water applicator 43 disposed after the antechamber 42 for applying water as an activator for promoting thermal transfer process in a uniform layer to the exposed surface of the printing paper 40, and a cutter 44 disposed after the water applicator 43 for cutting off the exposed photosensitive printing paper 40 to individual print strips. Also included is a booklet container 45 in which a number of blank booklets 5 are stored in a stack with their image receiving layers up, a pair of pressure applying rollers 46 for superimposing and applying pressure between the print strip of the exposed thermal printing paper 40 and the image receiving layer 1 of a booklet 5 picked up from the booklet container 45 so as to squeeze out air therebetween, a thermal image printing head 47 for applying heat to the print strip of the printing paper 40 and the image receiving layer 1 of the booklet 5 superimposed in order to perform a thermal developing and transferring process, a container 48 into which the booklet 5 with a composite image transferred thereto is stacked, and a wastepaper container 49 into which the used print strip of the printing paper 40 is thrown away.

The printing CRT 29 sequentially displays a composite image as a black-and-white image in the form of a brightness pattern by color which is projected onto the photosensitive printing paper 40 by means of a printing lens 52 during the opening of a shutter 51 controlled by a shutter controller 50. For translating each black-and-white image into a corresponding monochromatic image, there are provided three color filters, namely blue, green and red filters 53, 54, and 55, respectively, which are inserted into a printing path defined by the printing lens 52 independently of each other so as to perform a three color frame sequence exposure. These filters are controlled by a filter drive controller 56. As shown by the arrows in FIG. 6, filter drive controller 56 is actuated by a signal from control circuit 36 during video printing, and selectively drives the blue, green, and red filters 53, 54, and 55, respectively, to insert one or more of them into the printing path. The printing CRT 29 may be replaced with well known image display devices such as LED image display devices, LC image display devices, laser image display devices or the like.

The printing paper 40, after having been exposed, is intermittently transported into the antechamber 42. After passing the antechamber 42, the water applicator 43 applies water to the exposed surface of the printing paper 40. The application of water by the water applicator may be omitted if the image receiving layer 1 contains heat soluble activator for promoting a thermal image transfer process such as ureas, crystallized water, micro-capsules or the like.

After the application of water, the exposed printing paper 40 is cut into print strips by the cutter 44. Each print strip is laid on top of the image receiving layer 1 of a booklet 5 picked up from the booklet container 45. The pressure applying rollers 46 superimposes the print strip and the image receiving layer 1 of the booklet 5 and applies pressure therebetween to distribute water applied by the water applicator 43 in a uniform layer over the exposed surface of the print strip of the printing paper 40 and/or the image receiving layer 1. The superimposed printing strip and image receiving layer 1 of the booklet 5 is placed between, and heated by, upper and lower heating plates of the thermal image transfer head 47 so as to develop and transfer the thermal image to the image receiving layer 1 from the print strip of the printing paper 40. Because the thermal printing step is relatively long, a plurality of thermal printing heads 47 is preferably provided for processing a plurality of booklets 5 simultaneously. Thus processed, the booklet 5 is put into the container 48 while the print strip 40*a* of the printing paper 40 is discarded into the wastepaper container 49.

In the finishing step 130, as shown in FIGS. 3 and 4, the transparent cover sheet 2, bearing the image receiving layer 1 with a composite image transferred thereto in a thermal transfer process, is superimposed over, and adhered to, the supporting sheet 3 through the adhesive layer 4 as one page. Finally, after inspecting the identity between the personal data and the picture of the face of the applicant and so forth, the booklet 5, as a machine readable passport, is delivered to the applicant.

The composite image thermally printed on the passport includes personal data comprising optically readable characters which provides the identity of the passport holder. The passport can be used as a machine readable passport which is checked by an optical character reading machine.

Figure 9:
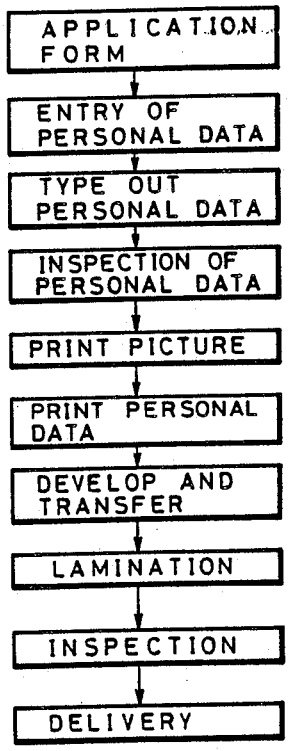
FIG. 9 is a flow chart illustrating another process of making the machine readable passport of the present invention.

Referring now to FIGS. 9 to 11, there is shown an apparatus for making a machine readable passport according to another preferred embodiment of the present invention. As shown in FIG. 10, after having accepted an application form 11 with a picture of the face 11*a* and personal data of the applicant, the necessary personal data are edited and printed out on a data sheet 65 with characters, or common data, and pattern previously printed thereon by a word processor based on the personal data from the application form 11. After the inspection of the personal data printed on the data sheet 65, the photosensitive printing paper 40 is exposed directly to the picture 11*a* of the applicant's face attached to the application from 11 and, then, to the data sheet 65. The exposed photosensitive paper is developed in a developing process and a composed image on the photosensitive paper is transferred onto the image receiving layer formed on the supporting sheet or the transparent cover sheet bound in the booklet. Finally, the supporting sheet and the transparent cover sheet are adhered to each other to sandwich the image receiving layer with the composed image therebetween. After inspecting the composite image, and, in particular the coincidence between the picture and the personal data, the booklet is delivered as a machine readable passport to the applicant.

The printing apparatus for making the machine readable passport is shown in FIG. 10 wherein the same reference characters denote the same or similar elements or parts as in the video printer 15 shown in FIG. 7. The printing apparatus 60 includes the paper cassette 41 containing a roll of photosensitive printing paper 40, first exposure means including a printing lens 63 for exposing the photosensitive printing paper 40 to the picture 11*a* of the face of the applicant attached to the application form 11, and second exposure means including a printing lens 66 for exposing the data sheet 65 placed adjacent to the applicant form 11 onto the same frame of the photosensitive printing paper 40. The printing apparatus further includes the antechamber 42 disposed after the second exposure means for retaining the exposed photosensitive printing paper 40 in the form of a loop, the water applicator 43 disposed after the antechamber 42 for applying water in a uniform layer to the exposed surface of the photosensitive printing paper 40 as an activator for promoting thermal transfer process, and a cutter 44 disposed after the water applicator 43 for cutting off the exposed photosensitive printing paper 40 to individual print strips. Also included is a booklet container 45 in which a number of booklets 5 are stored in a stack with their image receiving layers up, a pair of pressure rollers 46 for superimposing and applying pressure between the print strip of the exposed photosensitive printing paper 40 and the image receiving layer 1 of a booklet 5 picked up from the booklet container 45 so as to force out air therebetween, a thermal image printing head 47 for applying heat to the print strip of the photosensitive printing paper 40 and the image receiving layer 1 of the booklet 5 superimposed thereon, a container 48 into which the booklet 5 with an image transferred is stacked, and a wastepaper container 49 into which the used print strip of the photosensitive printing paper 40 is discarded.

The first exposure means 61 includes an illumination lamp (not shown) for illuminating the picture 11*a* on the application form 11 from the upper left of the picture 11*a*, a first printing lens 63 for projecting an image of the picture 11*a* on the application form 11 onto a frame of the photosensitive printing paper 40, and a first exposure framing mask 64 disposed close to the photosensitive printing paper 40 to expose only the picture 11*a* on the application form 11 to the photosensitive printing paper 40.

The second exposure means 62 includes an illumination lamp (not shown) for illuminating the data sheet 65 adjacent to the application form 11 from the upper right of the data sheet 65 on which the personal data 1*a*, a graphic image 1*c* and optically readable characters 1*d* for providing the applicant's identification are printed. The second exposure means further includes a second printing lens 66 for projecting an image of the data sheet 65 onto the same frame of the photosensitive printing paper 40 onto which the picture 11*a* is exposed, and a second exposure framing mask 67 disposed adjacent to the first exposure framing mask 64 and close to the photosensitive printing paper 40 to expose an image of the data sheet 65 to the photosensitive printing paper 40.

As shown in FIGS. 11A and 11B, the first and second exposure framing masks 64 and 67 are formed with different openings 64*a* and 67*a*, respectively, for defining exposure areas. Due to the provision of the different framing masks 64 and 67, there are printed images of the picture 11*a* and the data sheet 65 at different positions but on the same frame of the photosensitive printing paper 40.

Figure 12:
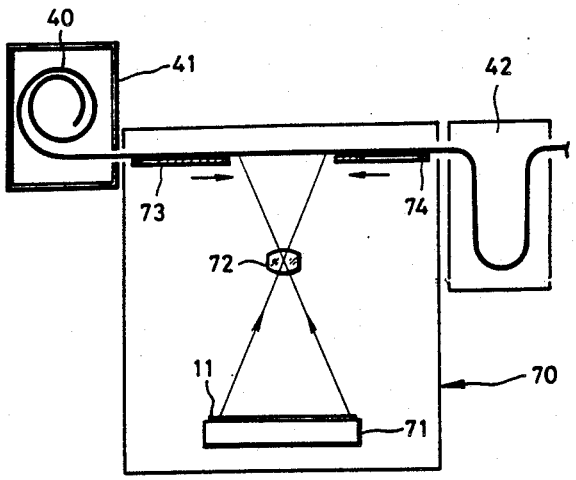
FIG. 12 is a schematic side view of an example of a composite image printing unit of the printing apparatus.

A composite image printing unit 60 may replace first and second exposure means 61 and 62. As shown in FIG. 12, the composite image printing unit 70 comprises a stationary table 71 on which the application form 11 or the data sheet 65 is placed, a printing lens 72 for projecting an image of the picture 11*a* attached to the application form 11 or the data sheet 65 onto the photosensitive printing paper 40, and first and second framing mask 73 and 74 which are interchangeably placed above the printing lens 72 to define exposure areas similar to those shown in FIGS. 11A and 11B. When the picture 11*a* of the application form 11 is printed, the first framing mask 73 is moved and placed over the printing lens 72. After the printing of the picture 11*a*, the application form 11 is replaced with the data sheet 65. Thereafter, the first framing mask 73 is removed, and the second framing mask 74 is moved and placed over the printing lens 72 for printing the data sheet 65.

Figure 13:
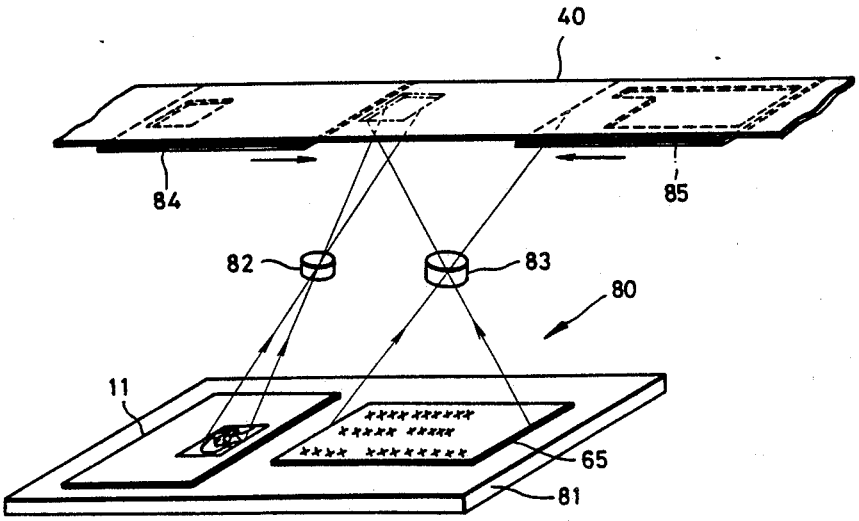
FIG. 13 is a schematic, perspective side view of another example of a composite image printing unit of the printing apparatus.

FIG. 13 illustrates an alternative composite image printing unit 70, in which a composite image printing unit 80 is provided with a pair of printing lenses 82 and 83 for projecting images of the application form 11 and the data sheet 65 placed on the table 81 side-by-side. First and second framing masks 84 and 85, which are the same as those of the composite image printing unit 70 of FIG. 12, are interchangeably placed above the table 81 to expose sequentially the images of the picture 11*a* of the application form 11 and the data sheet 65 onto the same frame of the photosensitive printing paper 40. In this embodiment, operation is simplified in comparison with using the composite image printing unit 70 because it is not necessary to replace the application form with the data sheet.

Figure 14:
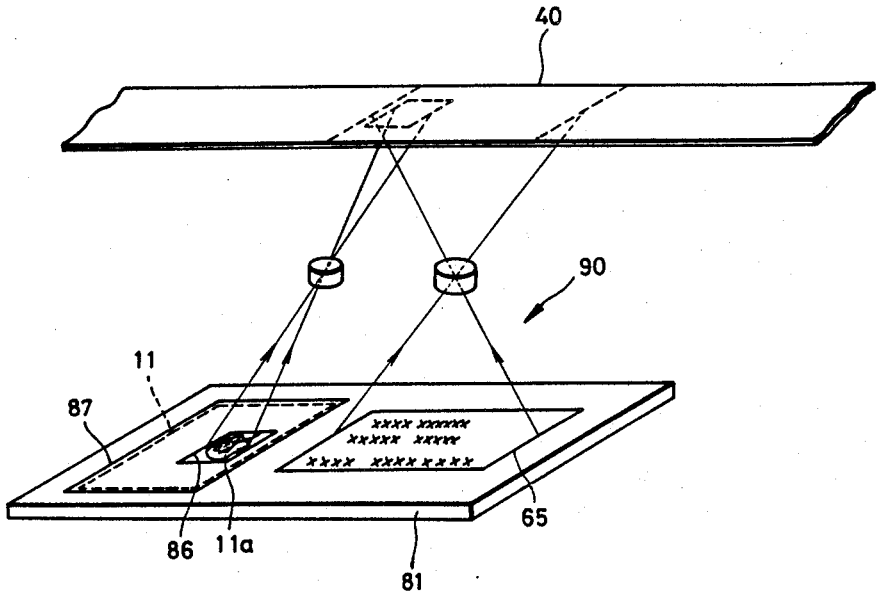
FIG. 14 is a schematic, perspective side view of still another example of a composite image printing unit of the printing apparatus.

FIG. 14 shows another alternative of the composite image printing unit 70 in which interchangeable framing masks are not used. In the composite image printing unit 90 of FIG. 14, the application form 11 and the data sheet 65 are placed on the table 81 side-by-side and are simultaneously projected onto a frame of the photosensitive printing paper 40 by means of a pair of printing lenses. However, the application form 11 is covered with a light blocking mask 87 made of, for example a blackened sheet, formed with an opening 86 for exposing the picture 11*a* of the application form 11.

Figure 15:
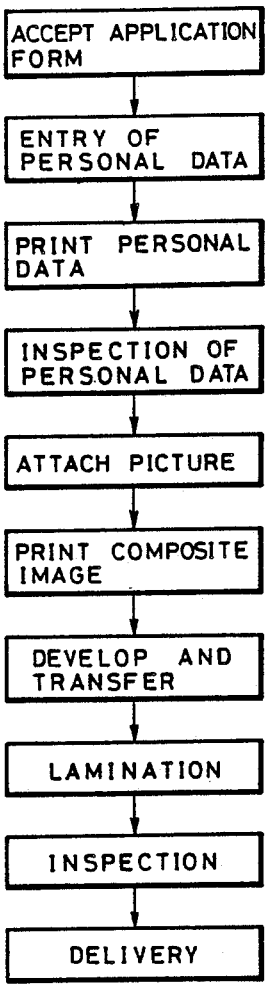
FIG. 15 is a flow chart illustrating the process of making a machine readable passport according to another preferred embodiment of the present invention.

In the case of optically providing a composite image of a picture and personal data, the process of making a machine readable passport according to the present invention may be changed partly as is shown in FIG. 15. In particular, it is possible to replace the steps of exposing first the photosensitive printing paper 40 directly to the picture 11*a* of the face of the applicant attached to the application form 11 and of exposing the same to the data sheet 65 in the process of FIG. 9, with the steps of attaching an extra picture of the applicant, rather than the picture attached to the application form, to the data sheet 65 with the personal data printed thereon and optically exposing the photosensitive printing paper 40 to the data sheet 65.

Figure 16:
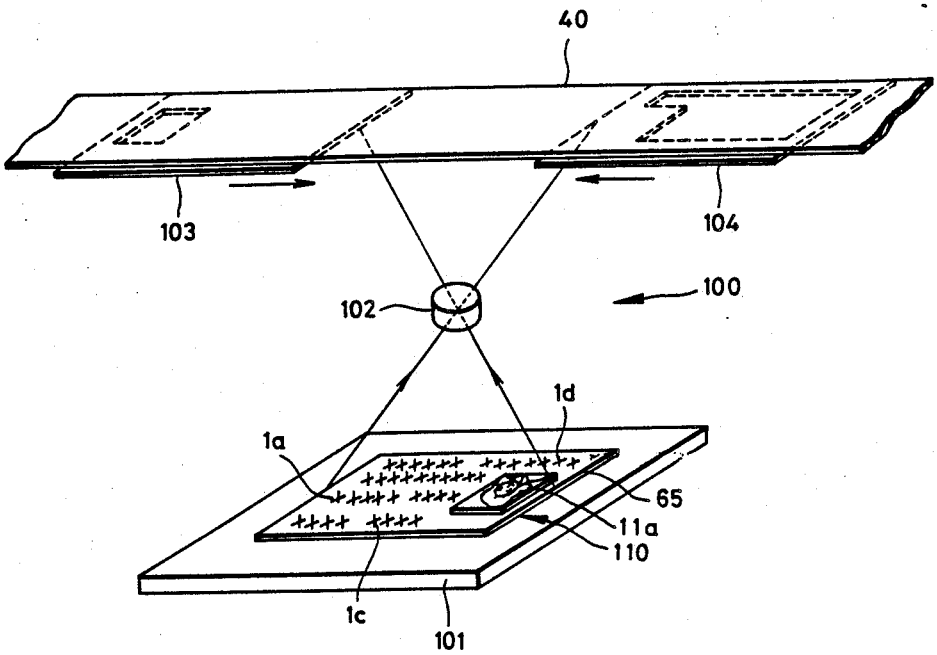
FIG. 16 is a schematic, perspective side view of an example of a composite image printing unit of the printing apparatus for printing a composite image in the process illustrated in FIG. 15.

For exposing the photographic printing paper 40, the composite image printing unit 100 shown in FIG. 16 is available. FIG. 16 shows the picture 11*a* of the applicant's face attached to the data sheet 65 provided with the personal data 1*a*, a graphic design 1*c*, and optically readable characters 1*d* for providing the passport holder's identity to form an original sheet 110. After placing the original sheet 110 on the table 101, the first framing mask 103 is moved and placed above the printing lens 102 to expose the picture 11*a* of the original sheet 110. Thereafter, the first framing mask 103 is removed, and the second framing mask 104 is moved and placed above the printing lens 102 for exposing the data sheet 65. If exposing separately the picture 11*a* and the data sheet 65 twice, an appropriate exposure time may be selected suitably for each of the picture and the data sheet. A print with high image quality should result. For shortening exposure time, exposing the picture 1*a* and the data sheet 65 on the original sheet 110, simultaneously, is possible.

Figure 17:
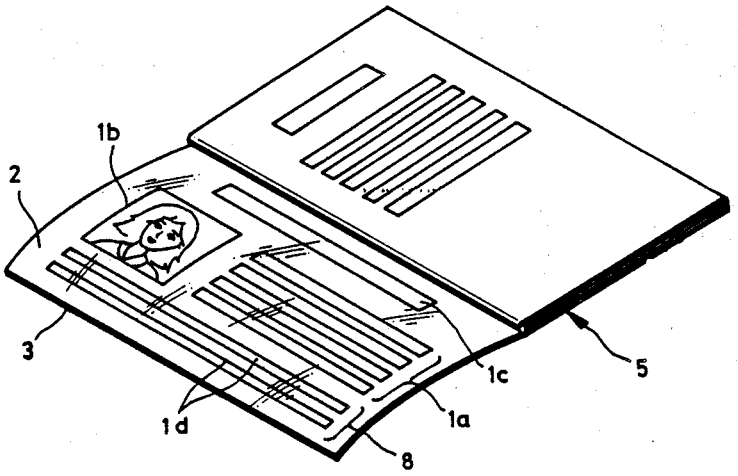
FIG. 17 is an illustration of a machine readable passport according to another preferred embodiment of the present invention.
Figure 18:
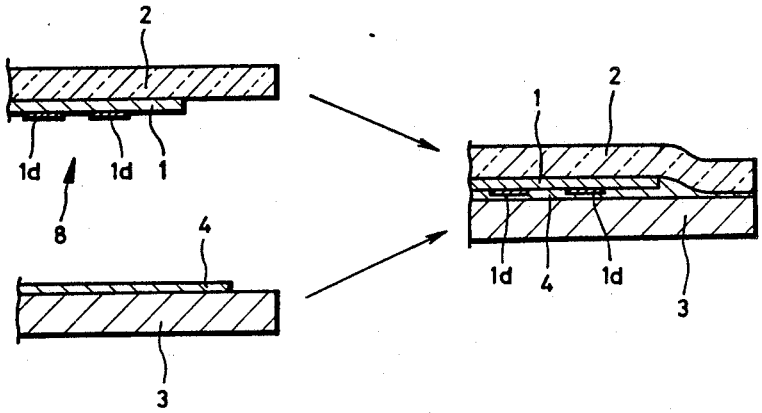
FIG. 18 is an explanatory illustration showing the construction of the machine readable passport of FIG. 17.

FIGS. 17 and 18 show a machine readable passport according to another preferred embodiment of the present invention in which a machine readable passport 5 contains a plurality of pages bound as one booklet. One page, for example a front cover page, comprises a transparent cover sheet 2 with an image receiving layer 1 of about 0.01 mm thickness coated onto the back surface thereof, and a supporting sheet 3 adhered to the back of the transparent sheet 2. Provided in the image receiving layer 1 are a composite image of personal data 1*a* of a passport holder, a picture 1*b* of the passport holder and a graphic design 1*c* photographically formed thereon, and optically readable personal data 1*d* described with optically readable characters printed with special ink directly on the image receiving layer in an optically readable data area 8. Ink used to print the machine readable data may be of any well known type of infrared absorption inks. It is noted that the optically readable data area 8 may be defined by an ink printable area provided on the image receiving layer 1 on the transparent sheet 2.

The transparent cover sheet 2 with the image receiving layer 1 is heat-welded to the supporting sheet 3 by way of a heat-melt type adhesive layer 4 coated onto the front surface of the supporting sheet 3 to form one page of the machine readable passport 5. As shown in FIG. 17, a picture 1*b* of the face and personal data 1*a* of the passport holder, and a graphic design 1*c* if necessary, are transferred onto the image receiving layer 1 in a thermal transfer process and optically readable special data 1*d* is printed with special ink. As previously described, these picture, graphic design, and personal data 1*a* are laid out and are composed as a single composite image on a CRT screen. Then, a thermal transfer type photosensitive printing paper 40 is exposed to the composed image displayed on the CRT screen to form a latent composite image thereon in a three color frame sequence exposure. Thereafter, it is developed in a thermal developing process. The developed composite image is finally transferred onto the image receiving layer 1.

The adhesive layer of, for example, 0.001 to 0.2 mm in thickness is provided over the back surface of the supporting sheet 3 to which the image receiving layer of the transparent sheet 2 is attached. Preferably, adhesive materials for the adhesive layer 1 are used which do not photographically or chemically attack the transferred composite image on the image receiving layer 1, but, adhere the transparent and supporting sheets together without forming air bubbles therebetween.

Figure 19:
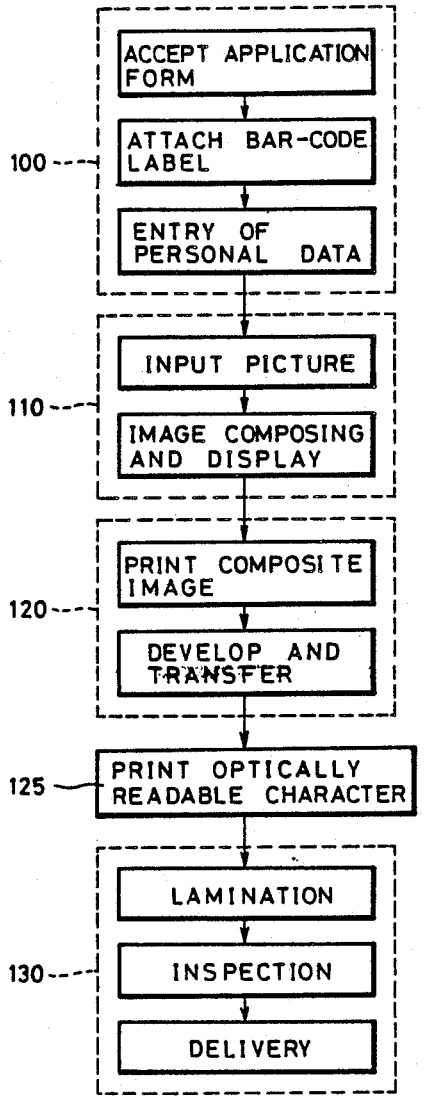
FIG. 19 is a flow chart illustrating the process of making the machine readable passport of the present invention shown in FIG. 17.
Figure 20:
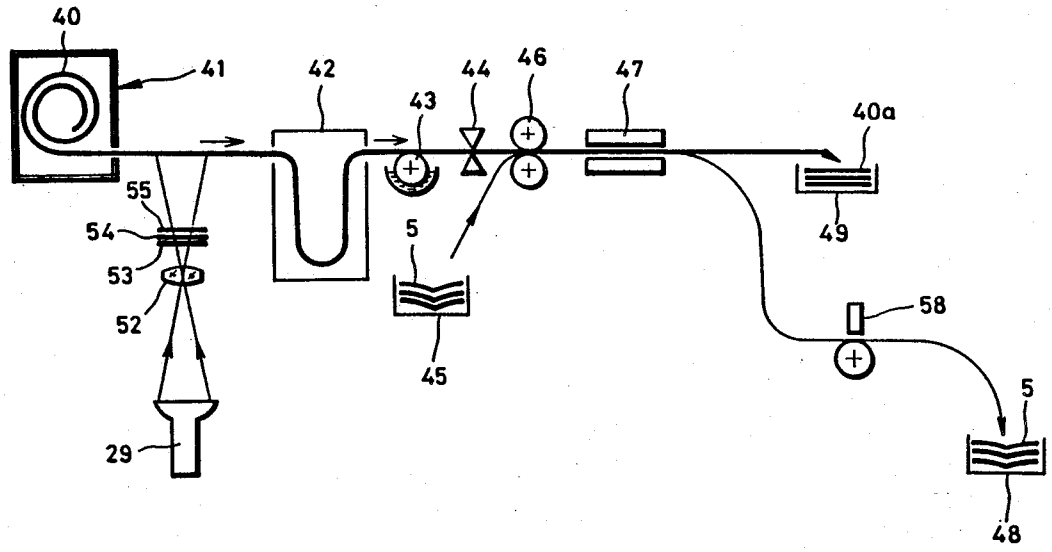
FIG. 20 is a schematic illustration similar to FIG. 7 but showing another video printer for performing the process shown in FIG. 19.

The process of making the machine readable passport is shown in FIG. 19 in which a step 125 of printing optically readable data with special ink is included in addition to steps 100, 110, 120 and 130 of the process shown in FIG. 4. Except for the optically readable data printing step 125, the process in FIG. 19 employs the same apparatus shown in FIG. 5 through 7 as described earlier. In the optically readable data printing step 125, optically readable personal data 1*d* is printed by a line printer 58 provided in a video printer shown in FIG. 20. The line printer may be any well known type. The optically readable personal data 1*d* is described by necessary personal data from the personal data 1*a* from the application form and is expressed by alpha-numeric characters readable by optical character readers (OCRs).

Figure 21:
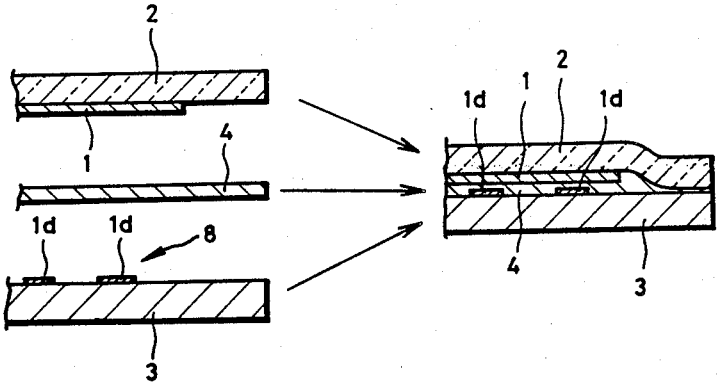
FIG. 21 is an explanatory illustration showing the construction of a machine readable passport according to still another preferred embodiment of the present invention.

FIG. 21 shows the construction of a machine readable passport according to still another preferred embodiment of the present invention. In this preferred embodiment, the optically readable personal data 1*d* is printed with ink in an optically readable data area 8 provided on the supporting sheet 3 rather than on the image receiving layer 1. The transparent and supporting sheets 2 and 3 are adhered together by means of an adhesive sheet 4 prepared separately therefrom to sandwich the image receiving layer 1 therebetween.

Figure 22:
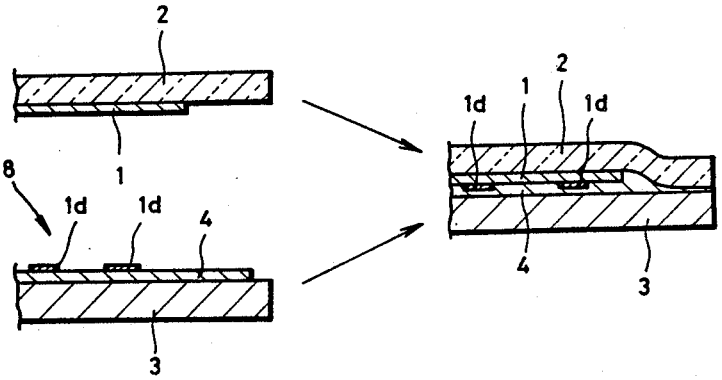
FIG. 22 is an explanatory illustration showing the construction of a machine readable passport according to yet another preferred embodiment of the present invention.

FIG. 22 shows the construction of a machine readable passport according to yet another preferred embodiment of the present invention. In this preferred embodiment, the optically readable personal data 1*d* is printed with ink in an optically readable data area 8 provided on an adhesive layer 4 coated over the supporting sheet 3. The transparent and supporting sheets 2 and 3 are adhered together by the adhesive sheet 4 prepared separately therefrom to sandwich the image receiving layer 1 therebetween.

Figure 23:
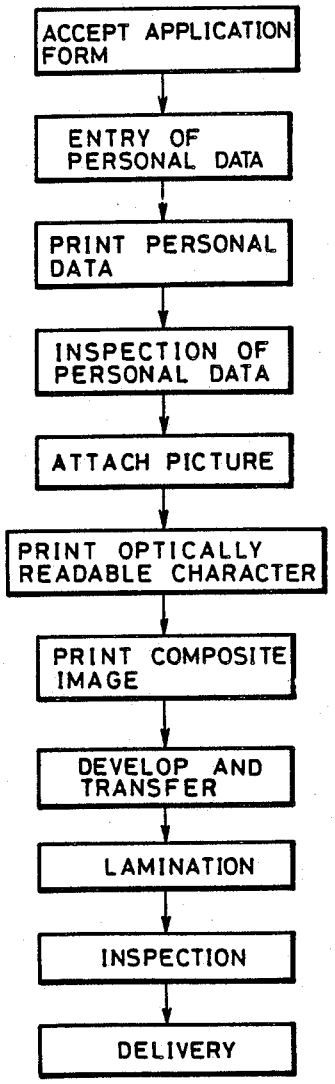
FIG. 23 is a flow chart illustrating the process of making the machine readable passport of the present invention shown in FIGS. 21 or 22.

The process of making the machine readable passport shown in FIG. 21 or 22 in which a step of printing the optically readable personal data on the supporting layer 3, or on the image receiving layer 1 of the supporting sheet 3, with special ink, is included in addition to all the steps of the process shown in FIG. 15. As shown in FIG. 23, the step of printing optically readable data is between the step of attaching an extra picture of the applicant's face, rather than the picture attached to the application form 11, to the data sheet 65 with the personal data printed thereon and the step of optically exposing the photosensitive printing paper 40 to the data sheet 65 with the extra picture attached and the personal data printed thereto.

Figure 24:
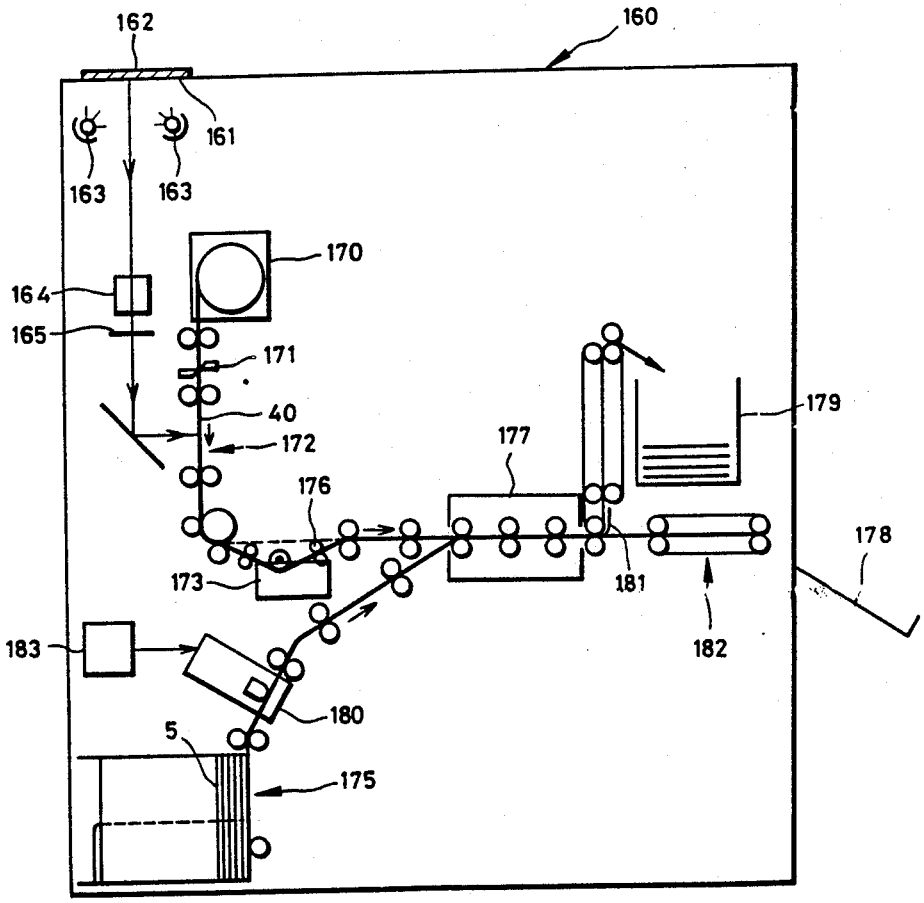
FIG. 24 is a schematic illustration showing a printer for making the machine readable passport of FIGS. 20 or 21.

FIG. 24 shows a printer for printing the optically readable personal data on the supporting sheet 3 or the image receiving layer 1 of the supporting sheet 3, and developing and transferring a composite image formed in the photosensitive printing paper 40 to the image receiving layer 1. As shown, the printer 160 has an exposure table 161 on which an original sheet 162 with the data sheet 65 and the extra picture attached, is placed front side back. The table is made of a transparent glass. The original sheet 162 is illuminated by lamps 163 and is projected by means of a printing lens 164 through a shutter 165 onto the thermal transfer type photosensitive printing paper 40 which is withdrawn from a paper cassette 170. The photosensitive printing paper 40 is withdrawn one frame at a time and is transported to an exposure position 172 to be exposed. After exposure, the exposed photosensitive printing paper 49 is cut by a cutter 171.

Provided after the exposure position 172 are a water applicator 173 for applying water to the exposed photosensitive printing paper 40, a pressure applying roller 176, and a thermal image developing and printing unit 177. Below the water applicator 173, there is a container 175 in which a number of blank passports 5 are stacked. The uppermost blank passport of the stacked blank passports 5 is picked up and transported by means of a conveyor belt to superimpose the exposed photosensitive printing paper 40 over the image receiving layer 1 of the transparent sheet 2 of the blank passport 5 in the thermal image developing and printing unit 177 after having printed the optically readable personal data 1*d* on the supporting sheet 3, or the adhesive layer 4 of the supporting sheet 3, by a line printer 180. After the thermal image developing and printing unit 177, there is a printing paper remover 181 for removing the photosensitive printing paper from the image receiving layer 1 of the transparent sheet 2, a wastepaper container 179 for receiving printing papers removed from the image receiving layer 1 of the transparent sheet 2 of the passport 5 by the printing paper remover 181, a dryer 182 for drying the passport 5, and a tray 178 for receiving the finished passport 5.

The line printer 180 is linked to a controller 183. The controller 183 causes the line printer 180 to print necessary optically readable personal data in the form of an optically readable character, or bar code, on the optically readable personal data printing area 8 of the supporting sheet 3. The line printer 180 also may print on the optically readable personal data printing area 8 of the adhesive layer 4 adhered to the supporting sheet 3. This optically readable data is retrieved from a floppy disk or the like in which the personal data described in the data sheet 65 has been recorded. Otherwise, the necessary personal data to be printed with optically readable characters may be entered through a keyboard. If desired, personal data 1*a* as well as optically readable personal data 1*d* attached to the original sheet 162 may be provided by the line printer 180.

The booklet according to the present invention can be available as various personal booklets or personal cards with a picture of the holders face. These booklets or cards include identification cards, driving licenses, and so on which are essential, in particular, in providing the bookholder's or cardholder's identity. The booklet according to the present invention may also be provided with a magnetic strip.

The described above invention is intended to be illustrative and not limiting. Various changes or modifications in the embodiments described may occur to those skilled in the art and these can be made without departing from the scope of the invention.

What is claimed is:

1. A booklet for identifying a holder thereof, said booklet being provided with a picture of the face and personal data of said holder, which comprises:

a transparent sheet bound in said booklet;

an image receiving layer formed on one surface of said transparent sheet, said image receiving layer including a composite image of said picture and said personal data; and a supporting sheet bound in said booklet separately from and next to said transparent sheet, said supporting sheet being adhered to said transparent sheet to sandwich said image receiving layer therebetween.

2. A booklet as defined in claim 1, wherein said composite image comprises an image optically printed on a thermal transfer type photosensitive printing paper and thermally transferred onto said image receiving layer.

3. A booklet as defined in claim 1, wherein said composite image comprises a computer-generated image.

4. A booklet as defined in claim 1, wherein said composite image comprises an optically provided image.

5. A booklet as defined in claim 1, wherein said supporting sheet includes an adhesive layer.

6. A booklet as defined in claim 1, further comprising an adhesive layer applied to one of said supporting sheet and said image receiving layer.

7. A booklet as defined in claim 1, further comprising an adhesive sheet adhering said transparent sheet to said supporting sheet.

8. A booklet for identifying a holder thereof, said booklet being provided with a picture of the face and personal data of a booklet holder, which comprises:

a transparent sheet and a supporting sheet bound in said booklet separately from and adjacent to each other;

an image receiving layer formed on one surface of one of said transparent and supporting sheets, said image receiving layer includes an image of at least one of said picture and said personal data;

an optically readable data printing area provided on said one of said transparent and supporting sheets and having optically readable personal data of said booklet holder; and an adhesive layer for adhering said transparent and supporting sheets to sandwich said image receiving layer therebetween.

9. A booklet for identifying a holder thereof, said booklet being provided with a picture of the face and personal data of said holder, which comprises:

a transparent sheet and a supporting sheet bound in said booklet separately from and adjacent to each other;

an image receiving layer formed on one surface of said transparent sheet, said image receiving layer including a composite image of said picture and said personal data;

an optically readable data printing area provided on said supporting sheet having optically readable personal data of said booklet holder; and an adhesive layer for adhering said transparent and supporting sheets to sandwich said image receiving layer therebetween.

10. A booklet as defined in claim 9, wherein said adhesive layer is an adhesive sheet.

11. A booklet according to claims 8 or 10, wherein said optically readable data printing area is not overlapped on said image receiving area.

12. A booklet according to claims 8 or 10, wherein said optically readable data printing area is overlapped on said image receiving area.

13. A booklet as defined in any one of claims 8 through 10, wherein said image receiving layer comprises an image thermally transferred from a photosensitive printing paper.

14. A booklet according to claims 8 or 9, wherein said adhesive layer comprises a peelable sheet adhered to said supporting sheet and said image receiving layer.

15. A booklet for identifying a holder thereof, said booklet being provided with a picture of the face and personal data of said holder, which comprises:

a transparent sheet and a supporting sheet bound in said booklet separately from and adjacent to each other;

an image receiving layer formed on one surface of one of said transparent and supporting sheets, wherein said image receiving layer includes an image of said picture and personal data, and optically readable personal data in said image receiving layer; and an adhesive layer for adhering said transparent and supporting sheets to sandwich said image receiving layer therebetween.

16. A booklet as defined in claim 15, wherein said image receiving layer comprises said image thermally transferred from a photosensitive printing paper.

17. A booklet according to claims 15 or 16, wherein said adhesive layer is formed on one of said transparent and supporting sheets.

* * * * *